US010979790B2

(12) United States Patent
Gu

(10) Patent No.: US 10,979,790 B2
(45) Date of Patent: Apr. 13, 2021

(54) SOUND DEVICE

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,156

(22) Filed: Jul. 28, 2019

(65) Prior Publication Data

US 2020/0045392 A1 Feb. 6, 2020

(30) Foreign Application Priority Data

Aug. 1, 2018 (CN) ..... 201821241497.6

(51) Int. Cl.

| | |
|---|---|
| ***H04R 1/02*** | (2006.01) |
| ***H04R 1/28*** | (2006.01) |
| ***H04R 9/06*** | (2006.01) |
| ***H04R 9/02*** | (2006.01) |

(52) U.S. Cl.

CPC ..... *H04R 1/02* (2013.01); *H04R 1/2811* (2013.01); *H04R 9/025* (2013.01); *H04R 9/06* (2013.01); *H04R 2400/11* (2013.01)

(58) Field of Classification Search

CPC ..... H04R 1/02; H04R 1/021; H04R 1/2811; H04R 2400/11; H04R 9/06; H04R 9/025

See application file for complete search history.

(56) References Cited

U.S. PATENT DOCUMENTS

2008/0057305 A1* 3/2008 Grose ..... B29C 65/544 428/343

2016/0241938 A1* 8/2016 Huang ..... H04R 1/023

* cited by examiner

*Primary Examiner* — Sunita Joshi

(74) *Attorney, Agent, or Firm* — W&G Law Group LLP

(57) ABSTRACT

The present disclosure provides a sound device, comprising a frame and a front cover disposed on the frame by covering the frame, wherein the frame extends towards the front cover to form an ironing spot column, the front cover comprises a body portion disposed on the frame by covering the frame and a positioning hole penetrated through the body portion and fitted with the positioning hole, the ironing spot column is inserted in the positioning hole, wherein the ironing spot column comprises a column main body and a glue receiving groove formed by recessing from an outer surface of the column main body towards inside of the column main body; the column main body passes through the positioning hole so that the glue receiving groove is in communication with the positioning hole, and the glue receiving groove is filled with glue.

5 Claims, 3 Drawing Sheets

SOUND DEVICE

TECHNICAL FIELD

The present disclosure relates to the field of electro-acoustic conversion, in particular to a sound device applied to a portable electronic product.

BACKGROUND

As the mobile internet times are coming, the number of smart mobile devices continues to rise. Among many mobile devices, mobile phones are undoubtedly the most common and most portable mobile terminal devices. At present, the functions of mobile phones are extremely diverse, one of which is to provide high-quality music. Therefore, sound devices for playing sounds are widely used in smart mobile devices currently.

A sound device according to the related art includes a frame, a vibration system fixed to the frame and a magnetic circuit system for driving the vibration system to vibrate, and a front cover fixed to the frame, where, the frame extends to the front cover so as to form an ironing spot column, the front cover is provided with a positioning hole, the positioning hole penetrates through the front cover and is configured to fit with the ironing spot column, and the front cover is fixed to the frame by hot pressing the ironing spot column after the ironing spot column passes through the positioning hole.

However, in the sound device according to the related art, the ironing spot column has a cylindrical structure, and an ironing spot re-gluing is not utilized, thereby the stability of the front cover is limited and the acoustic performance of the sound device is even affected.

Therefore, it is necessary to provide a new sound device to solve the foregoing technical problems.

BRIEF DESCRIPTION OF THE DRAWINGS

In order to more clearly describe the technical solutions in the embodiments of the present disclosure, the drawings used in the description of the embodiments will be briefly described below. It is obvious that the drawings in the following description only relate to some embodiments of the present disclosure. For those skilled in the art, other drawings may also be obtained according to the accompanying drawings without any creative work, wherein.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments of the present disclosure, but not all of the embodiments. All other embodiments, obtained by a person of ordinary skill in the art based on the embodiments of the present disclosure without creative work, fall within the scope of the present disclosure.

Figure 1:
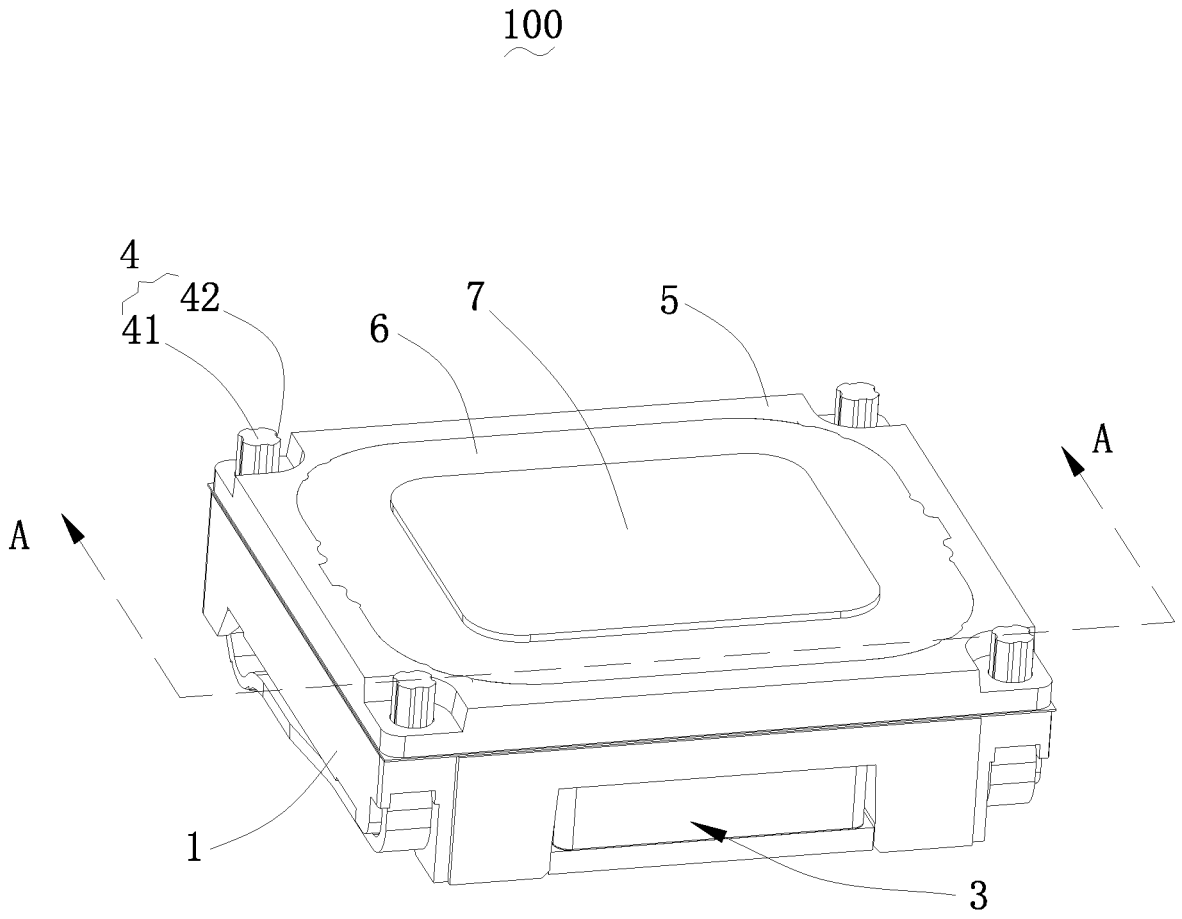
FIG. 1 is a schematic view illustrating a three-dimensional structure of a sound device according to the present disclosure.
Figure 2:
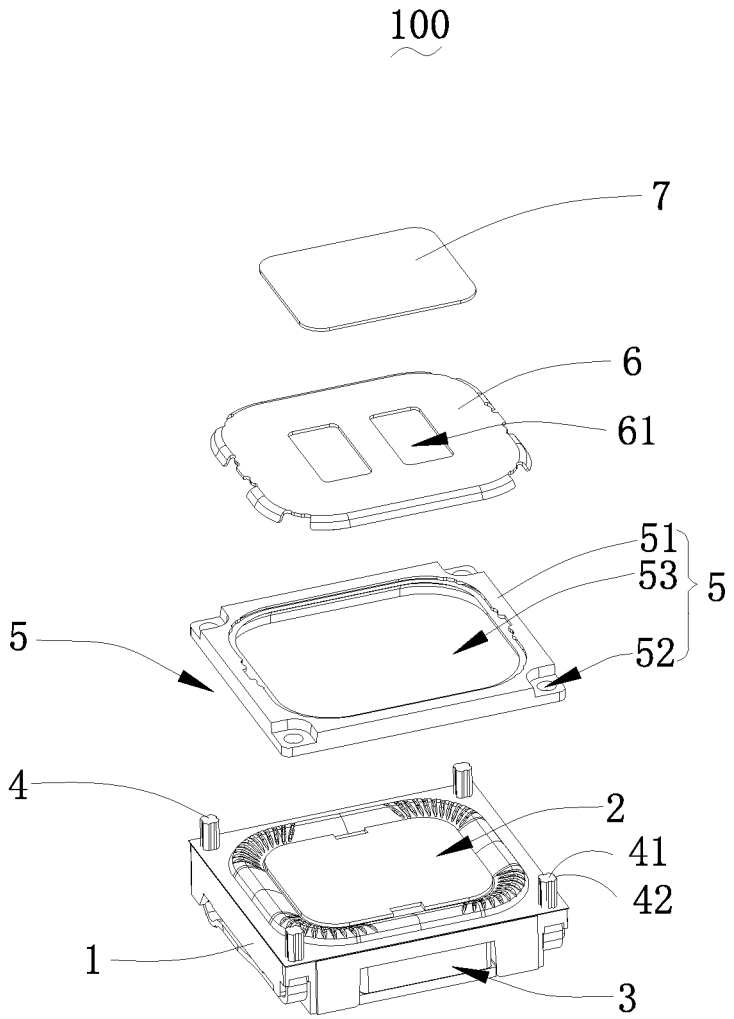
FIG. 2 is a schematic exploded view illustrating part of the three-dimensional structure of the sound device according to the present disclosure.
Figure 3:
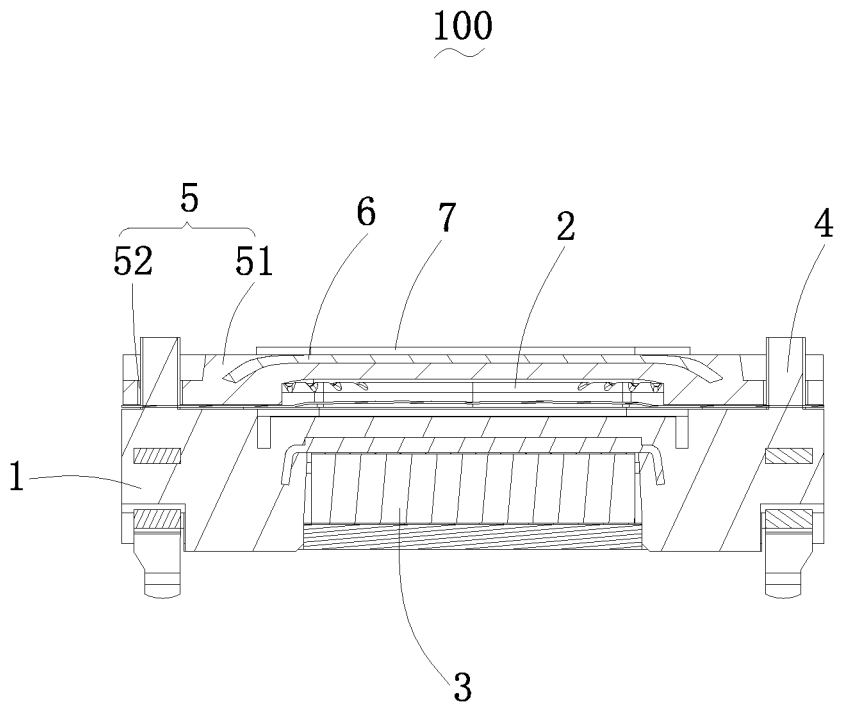
FIG. 3 is a cross-sectional view taken along line A-A of FIG. 1.

As shown in FIGS. 1-3, the present disclosure provides a sound device 100 including a frame 1, a vibration system 2, a magnetic circuit system 3, ironing spot columns 4, and a front cover 5.

In the present embodiment, the frame 1 is described by taking a frame having a rectangular shape as an example. Of course, the frame may have a circular shape or other shapes, but not limited thereto.

The vibration system 2 and the magnetic circuit system 3 are respectively fixed to the frame 1, and the magnetic circuit system 3 is configured to drive the vibration system 2 to generate sound by vibration. The frame 1, the vibration system 2 and the magnetic circuit system 3 jointly constitute a rear cavity (not labeled) for improving acoustic performance in low frequency of the sound device 100.

The ironing spot columns 4 are formed by extending the frame 1 to the front cover 5 and they are configured for fixing the front cover 5 to the frame 1.

In the present embodiment, there are four ironing spot columns 4 spaced apart from each other, but the number of ironing spot columns is not limited thereto. Specifically, the four ironing spot columns 4 are respectively located at the four corners of the frame 1.

The front cover 5 is disposed on the frame 1 for covering the frame 1, and the front cover 5 forms a front cavity together with the vibration system 2 for generating sound.

Specifically, the front cover 5 includes a body portion 51, positioning holes 52, and a sound output hole 53.

The body portion 51 is disposed on the frame 1 for covering the frame 1.

The positioning holes 52 are disposed through the body portion 51. The positioning holes 52 are fitted with the ironing spot columns 4, that is, the number of the positioning holes 52 is the same as that of the ironing spot columns 4. Each of the ironing spot columns 4 is inserted in and passed through a positioning hole 52, and a snap structure is formed by deforming ends of the ironing spot columns 4 through hot pressing, so that the front cover 5 is fixed to the frame 1.

The sound output hole 53 is disposed through the body portion 51 and communicates with a front cavity for generating sounds.

The ironing spot column 4 includes a column main body 41, a glue receiving groove 42 is formed by recessing an outer surface of the column main body 41 towards inside of the column main body. There may be a plurality of glue receiving grooves 42 disposed apart from each other around the column main body 41. The column main body 41 penetrates through the positioning hole 52 so that the glue receiving groove 42 is in communication with the positioning hole 52.

In one example, the column main body 41 is cylindrical, and the cross-section of the glue receiving groove 42 has a rectangular, trapezoidal or curved shape. The number of the glue receiving grooves 42 is four and they are disposed apart from each other, and the four glue receiving groove 42 are evenly disposed along the central axis of the column main body 41.

The inner side of the glue receiving groove 42 has a curved surface structure or an inclined structure or a stepped structure, which may utilize the containment and flow properties of the glue.

After the glue is filled into the glue receiving groove 42, the glue flows into a gap (not labeled) between the ironing spot column 4 and the positioning hole 52 for filling, so that the gap is eliminated, thereby reducing or even avoiding horizontal shaking of the front cover 5, such as, shaking along the long axis direction or the short axis direction of the frame 1, and thus the front cover 5 is fixed more stably. Meanwhile, the glue may flow between the frame 1 and the front cover 5 through the gap, such as between the contact faces of the frame 1 and the front cover 5, so that fixing by the glue is added between the frame 1 and the front cover 5, thereby increasing the fixing strength and stability between the front cover 5 and the ironing spotted frame 1 and improving tensile performance of the front cover 5 and further optimizing the acoustic stability of the sound device 100.

In order to alter the high frequency acoustic performance of the sound device 100, in the present embodiment, the sound device 100 further includes: a steel sheet 6 fixed to the front cover 5 and completely covering the sound output hole 53; and a sound absorbing layer 7 fixedly adhered to the steel sheet 6.

The steel sheet 6 is provided with a sound output hole 61, the sound output hole extends through the steel sheet 6 and is in communication with the front cavity, and the sound absorbing layer 7 completely covers the sound output hole 61. The Young's modulus of the steel sheet 6 is greater than that of the front cover 5, so that the high frequency acoustic performance of the front cavity could be improved, and the high frequency distortion of the sound absorbing layer 7 may effectively avoid, thereby making the acoustic performance of the sound device 100 superior.

It should be noted that the sound absorbing layer 7 in the present embodiment has a structure capable of flowing gas, which is made of a flexible material. More preferably, the sound absorbing layer 7 is adhered to a side of the steel sheet 6 away from the vibration system 2, and thus the arrangement does not occupy space of the front cavity, so that the vibration system has sufficient vibration space.

Compared with the related art, the sound device of the present disclosure forms a glue receiving groove by recessing inwardly at the outer surface of the column main body of the ironing spot column, the column main body passes through a positioning hole, and the glue receiving groove is filled with glue. Before spot ironing, the glue is filled. When the glue is filled into the glue receiving groove, the glue flows into the gap between the ironing spot column and the positioning hole for a filling, thereby reducing or even avoiding horizontal shaking of the front cover, and thus the front cover is fixed more stably. Meanwhile, the glue may flow between the frame and the front cover through the gap, such as between the contact faces of the frame and the front cover, thereby increasing the fixing strength and stability between the front cover and the frame after the spot ironing, and improving tensile performance of the front cover and further optimizing the acoustic stability of the sound device.

The above description only illustrates the embodiments of the present disclosure. It should be noted that those skilled in the art may make improvements thereto without departing from the inventive concept of the present disclosure, which shall be considered as falling within the protection scope of the present disclosure.

What is claimed is:

1. A sound device, comprising a frame and a front cover disposed on the frame by covering the frame, wherein, the frame extends towards the front cover to form an ironing spot column, the front cover comprises a body portion disposed on the frame by covering the frame, and a positioning hole penetrated through the body portion and fitted with the positioning hole, the ironing spot column is inserted in the positioning hole, wherein, the ironing spot column comprises a column main body and a glue receiving groove formed by recessing from an outer surface of the column main body towards inside of the column main body; the column main body passes through the positioning hole so that the glue receiving groove is in communication with the positioning hole, and the glue receiving groove is filled with glue, the column main body is a cylinder, and the inner side of the glue receiving groove has a curved surface structure, an inclined structure or a stepped structure.

2. The sound device according to claim 1, wherein the ironing spot column comprises a plurality of glue receiving grooves spaced apart from each other around the column main body.

3. The sound device according to claim 2, wherein the number of the glue receiving grooves is four, and the four glue receiving grooves are spaced apart from each other with even intervals.

4. The sound device according to claim 1, wherein the sound device comprises four ironing spot columns spaced apart from each other.

5. The sound device according to claim 4, wherein the frame is of a rectangle shape and the four glue receiving grooves are located at four corners of the frame respectively.

* * * * *